US008875449B2

(12) United States Patent
Calgaro et al.

(10) Patent No.: US 8,875,449 B2
(45) Date of Patent: Nov. 4, 2014

(54) CLOSURE SYSTEM FOR MEMORIAL PRODUCT

(71) Applicant: Cold Spring Granite, Cold Spring, MN (US)

(72) Inventors: James Daniel Calgaro, Avon, MN (US); Daniel A. Holthaus, Richmond, MN (US)

(73) Assignee: Cold Spring Granite Company, Cold Springs, MN (US)

( * ) Notice: Subject to any disclaimer, the term of this patent is extended or adjusted under 35 U.S.C. 154(b) by 0 days.

(21) Appl. No.: 13/840,323

(22) Filed: Mar. 15, 2013

(65) Prior Publication Data

US 2014/0109493 A1 Apr. 24, 2014

Related U.S. Application Data

(60) Provisional application No. 61/704,190, filed on Sep. 21, 2012.

(51) Int. Cl.
*E04H 13/00* (2006.01)
*E06B 5/00* (2006.01)

(52) U.S. Cl.
CPC ..... *E04H 13/006* (2013.01); *E06B 5/00* (2013.01); *E04H 13/00* (2013.01)
USPC ..... 52/137; 52/134; 52/489.2; 52/778; 52/779

(58) Field of Classification Search
CPC ..... E04B 2/56; E04B 2/72; E04B 2/74; E06B 5/00; E04H 13/00; E04H 13/006; E04H 13/008; E04C 2/00; E04F 13/00
USPC ..... 52/128, 133, 134, 137, 474, 489.2, 52/506.03, 506.09, 772, 778, 779
See application file for complete search history.

(56) References Cited

U.S. PATENT DOCUMENTS

| | | | | |
|---|---|---|---|---|
| 2,257,598 | A * | 9/1941 | Frease | 52/481.1 |
| 3,319,983 | A | 5/1967 | Zibell | |
| 3,561,182 | A | 2/1971 | Madl, Jr. | |

(Continued)

FOREIGN PATENT DOCUMENTS

| | | |
|---|---|---|
| JP | 2003-74137 | 3/2003 |
| KR | 10-2009-0043801 | 5/2009 |
| KR | 10-0987700 B1 | 10/2010 |
| WO | WO 2012/033499 A1 | 3/2012 |

*Primary Examiner* — Charles A Fox
*Assistant Examiner* — Patrick Maestri
(74) *Attorney, Agent, or Firm* — Merchant & Gould, P.C.

(57) ABSTRACT

A closure system for a memorial product, such as a columbarium, is disclosed. In one embodiment, the closure system is configured to be mounted to a niche compartment such that an opening of the niche compartment is covered. In one embodiment, the closure system includes a face plate hanger and a face plate. The face plate hanger may include first and second rails that are generally directed towards each other. The face plate may be provided with a first channel constructed to receive the first rail and a second channel constructed to receive the second rail. The face plate hanger may also include a cover panel that is configured to cover the niche opening. A columbarium is also disclosed in which a cabinet structure is provided that defines a plurality of niche compartments wherein each of the compartments has an opening that is covered by the above described closure system.

27 Claims, 16 Drawing Sheets

(56) References Cited

U.S. PATENT DOCUMENTS

| | | | | |
|---|---|---|---|---|
| 3,705,002 | A | 12/1972 | Varlonga | |
| 3,786,605 | A | 1/1974 | Winfrey | |
| 3,888,055 | A | 6/1975 | Gallo | |
| 4,899,508 | A | 2/1990 | Biebuyck | |
| 5,195,812 | A | 3/1993 | Eickhof | |
| 5,860,257 | A * | 1/1999 | Gerhaher et al. | 52/235 |
| 6,347,439 | B1 * | 2/2002 | Bach Lahor | 27/1 |
| 7,308,740 | B2 | 12/2007 | Roberts | |
| 8,122,650 | B2 * | 2/2012 | Eickhof | 52/134 |
| 8,245,457 | B2 | 8/2012 | Eickhof | |

* cited by examiner

CLOSURE SYSTEM FOR MEMORIAL PRODUCT

This application claims priority to U.S. Application Ser. No. 61/704,190 that was filed with the United States Patent and Trademark Office on Sep. 21, 2012. The entire disclosure of the U.S. Application Ser. No. 61/704,190 is incorporated herein by reference.

TECHNICAL FIELD

This disclosure relates to a closure system for a memorial product, such as a columbarium. Columbaria generally include one or more niches for storing cinerary urns. In some installations, removable covers or panels are provided for protecting and concealing the stored contents within a niche.

BACKGROUND

Columbaria, often constructed of marble or granite, are memorial products within which cinerary urns are stored in individual niches. Columbaria can be freestanding or part of another structure, such as a mausoleum. In some instances, the niches are viewable for public display. In other instances, especially in outdoor applications, the niches are sealed and closed such that the contents of the niche are protected. In some applications, each individual niche is provided with a separate closure that is mechanically secured to a structural portion of the columbarium. An additional cover may also be provided over the closure to ensure that the aesthetics of the columbaria are maintained. Such covers are sometimes secured to either the closure behind the cover or to a structural portion of the columbarium with additional mechanical fasteners, such as clips, bolts, screws, brackets, and other similar hardware that are not integral to the cover or the closure. In some applications, mechanical fasteners are concealed behind the covers such that they cannot be viewed from the exterior. Improvements are desired.

SUMMARY

A closure system for a memorial product, such as a columbarium, is disclosed. In one embodiment, the closure system is configured to be mounted to a niche compartment such that an opening of the niche compartment is covered. In one embodiment, the closure system includes a face plate hanger and a face plate. The face plate hanger may include a first rail provided at a first end of a niche compartment opening and a second rail provided at a second end, opposite the first end, of a niche compartment opening. The first and second rails may be generally directed towards each other. The face plate may be constructed to fit between the first rail and the second rail. In one embodiment, the face plate has a first channel constructed to receive the first rail and a second end comprising a second channel constructed to receive the second rail. The face plate hanger may also include a cover panel that is configured to cover the niche opening. A columbarium is also disclosed in which a cabinet structure is provided that defines a plurality of niche compartments wherein each of the compartments has an opening that is covered by the above described closure system.

BRIEF DESCRIPTION OF THE DRAWINGS

Non-limiting and non-exhaustive embodiments are described with reference to the following figures, which are not necessarily drawn to scale, wherein like reference numerals refer to like parts throughout the various views unless otherwise specified.

DETAILED DESCRIPTION

Figure 1:
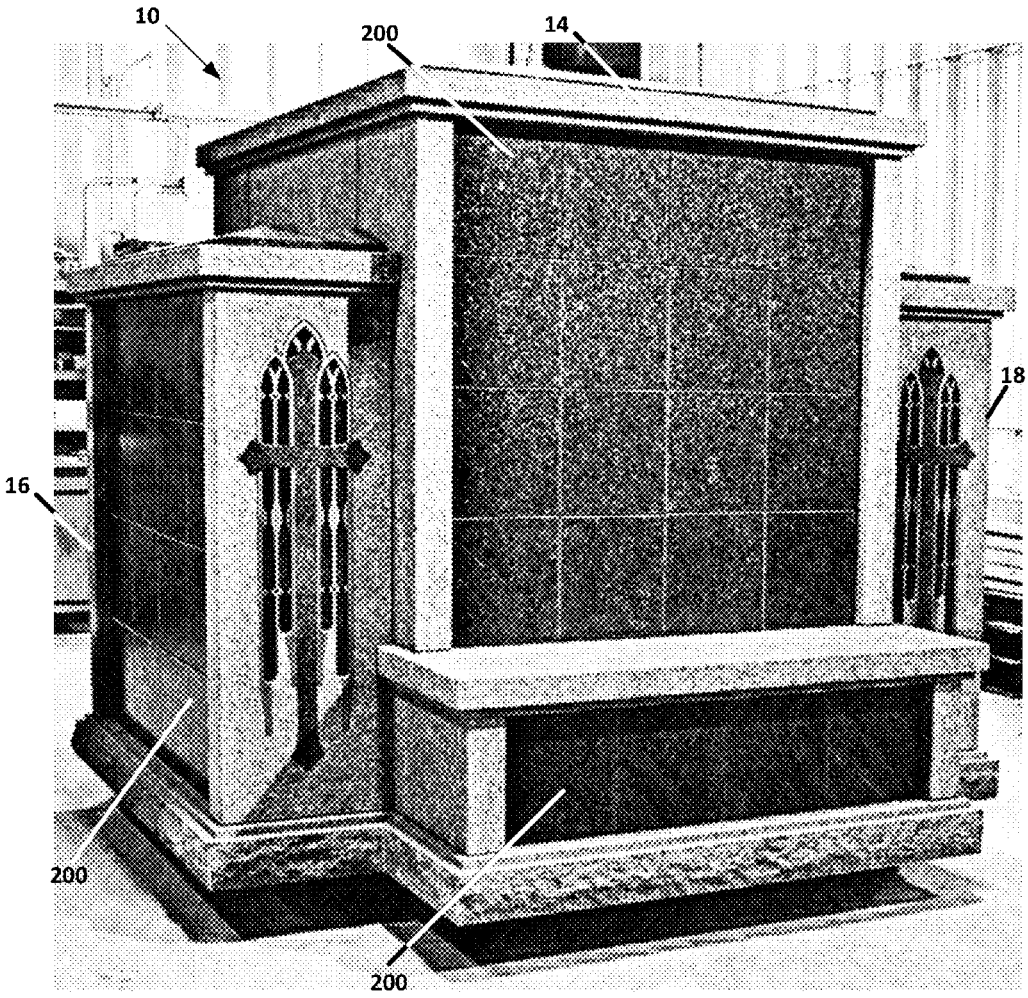
FIG. 1 is a front perspective view of a columbarium with a closure system having features that are examples of aspects in accordance with the principles of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Figure 2:
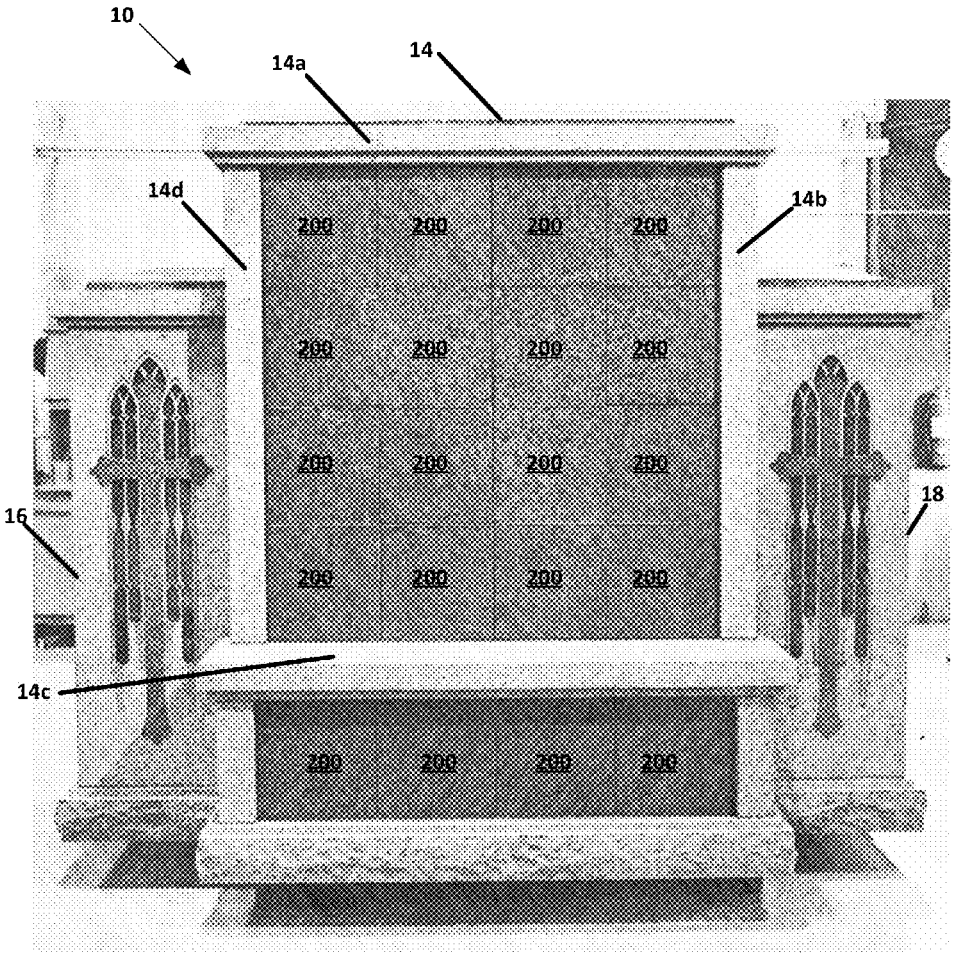
FIG. 2 is a front view of the columbarium and closure system of FIG. 1.
Figure 3:
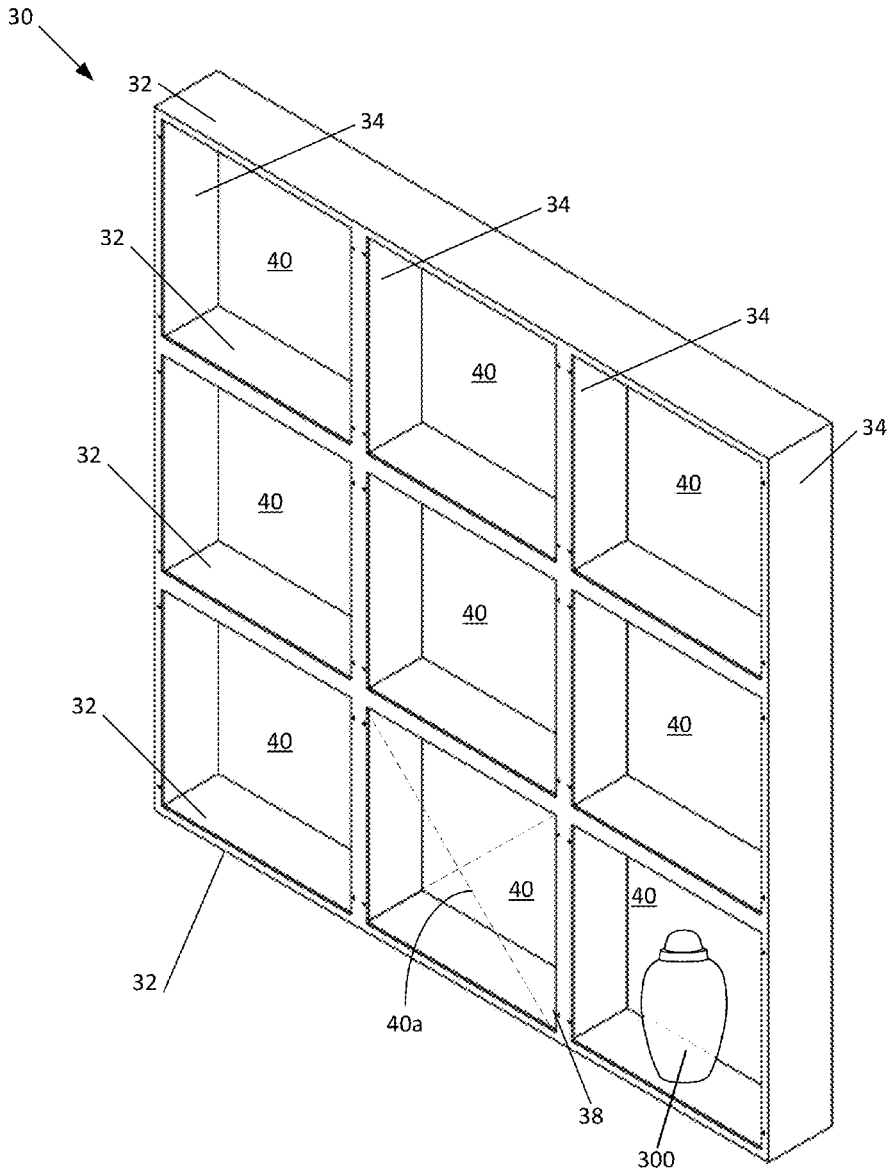
FIG. 3 is a front perspective view of a cabinet structure for use in a closure system having features that are examples of aspects in accordance with the principles of the present disclosure.
Figure 4:
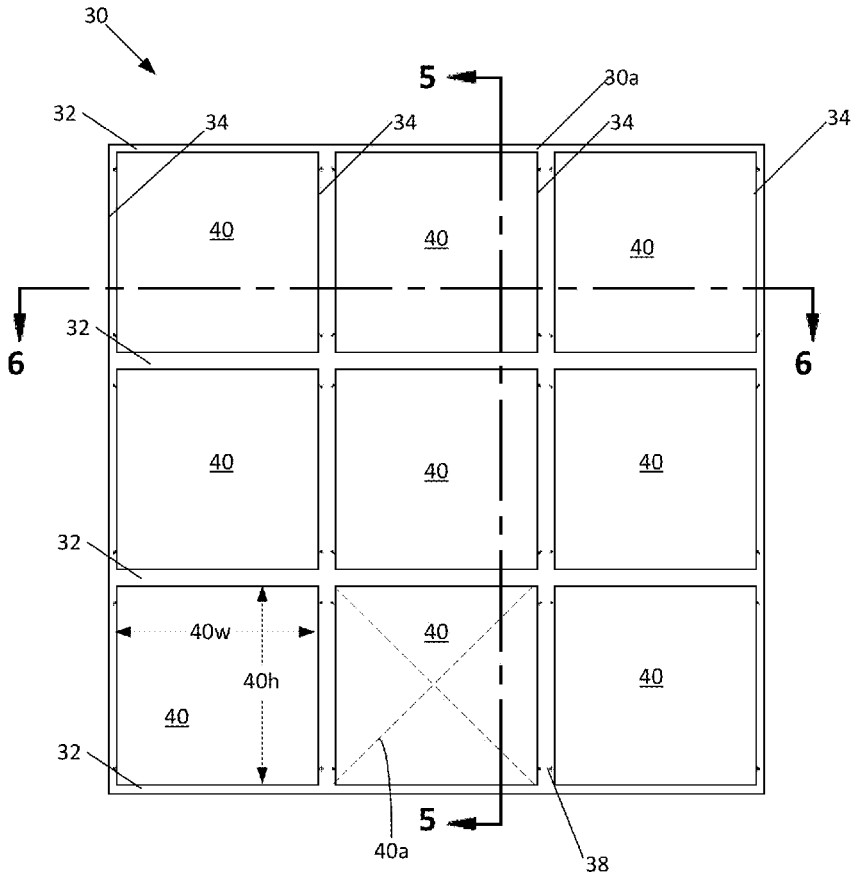
FIG. 4 is a front view of the cabinet structure of FIG. 3.
Figure 5:
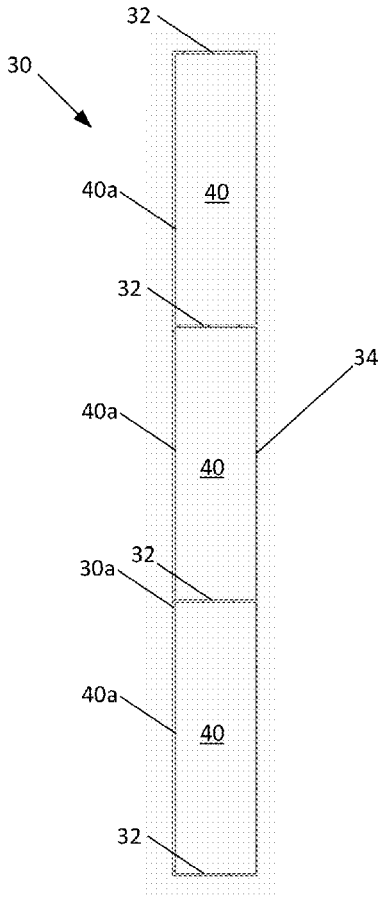
FIG. 5 is a cross-sectional view of the cabinet structure of FIG. 3, taken along the line 5-5.
Figure 6:
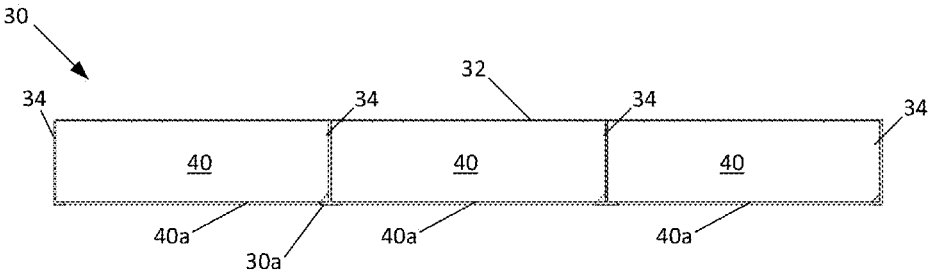
FIG. 6 is a cross-sectional view of the cabinet structure of FIG. 3, taken along the line 6-6.
Figure 7:
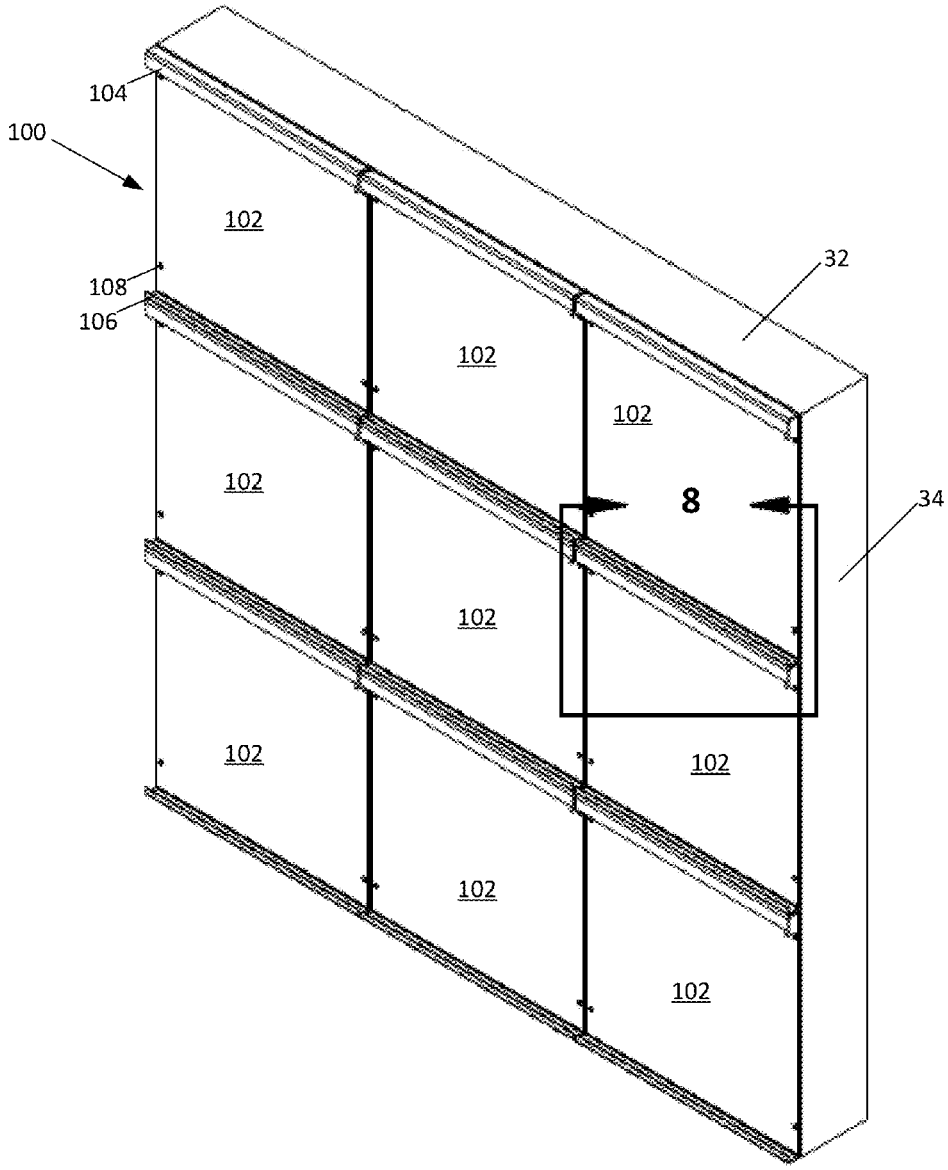
FIG. 7 is a front perspective view of the cabinet structure of FIG. 3 with closure panels installed.
Figure 8:
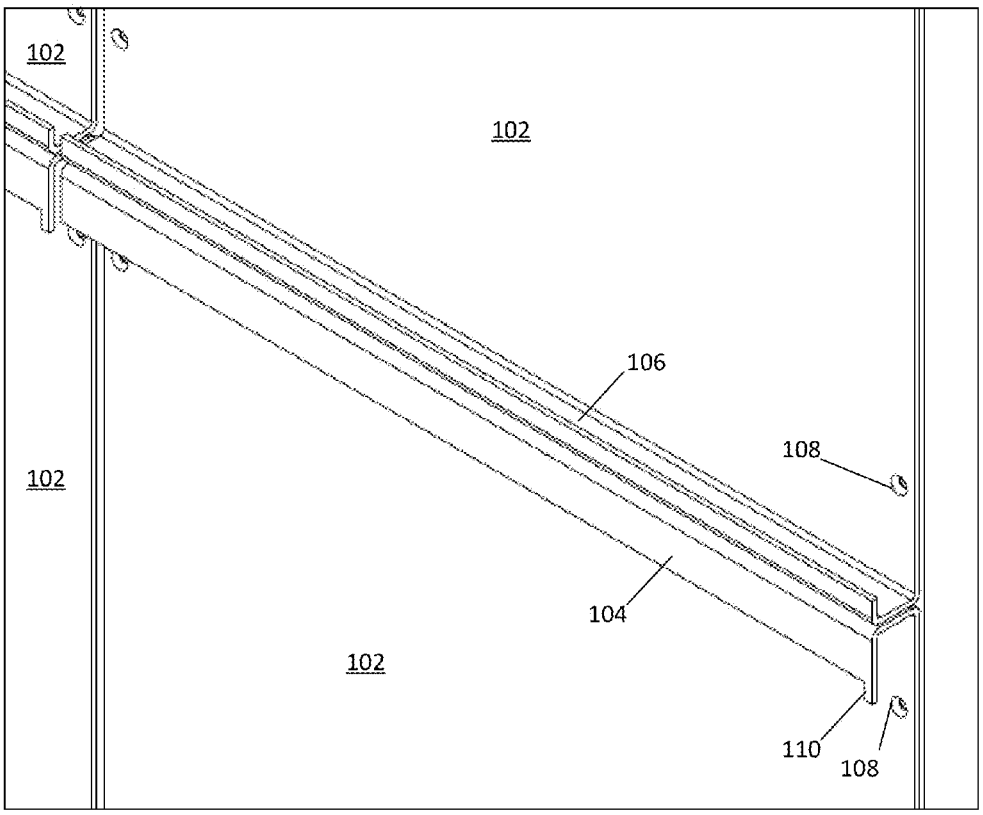
FIG. 8 is an enlarged view of a portion of the cabinet and closure panels shown in FIG. 7 at location 8.
Figure 9:
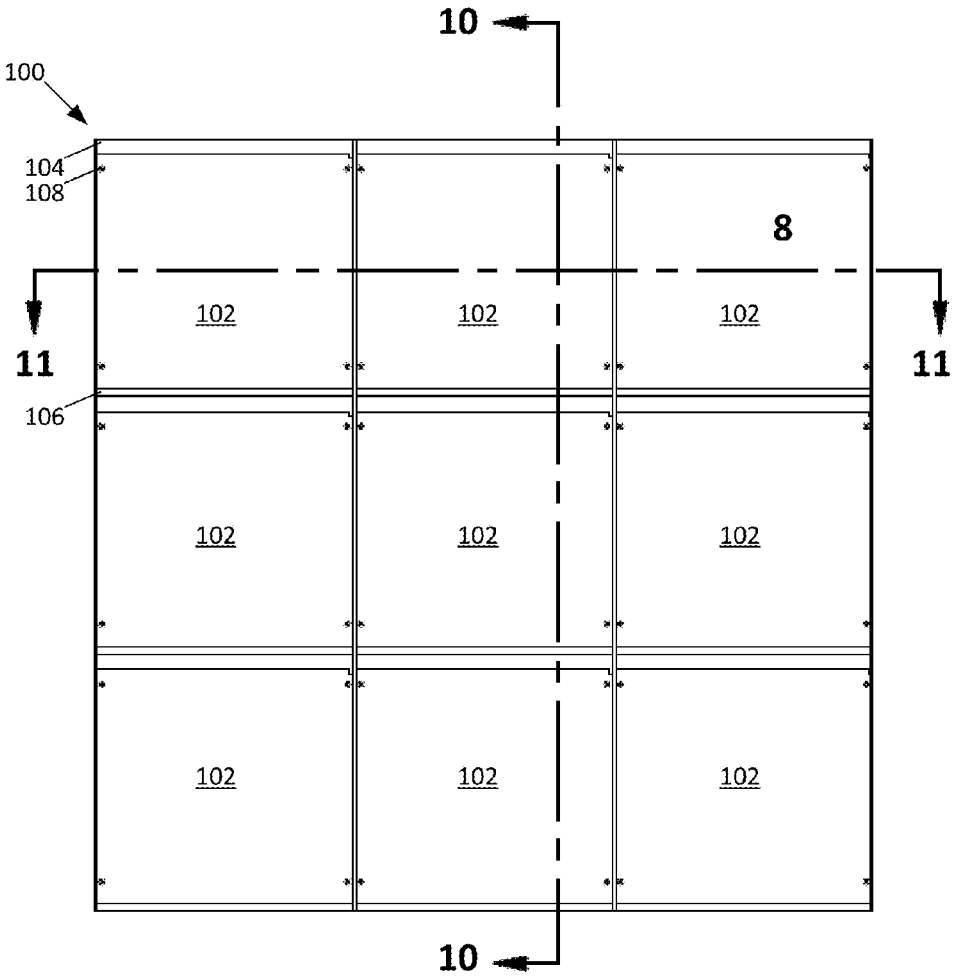
FIG. 9 is a front view of the cabinet and closure panels shown in FIG. 7.
Figure 10:
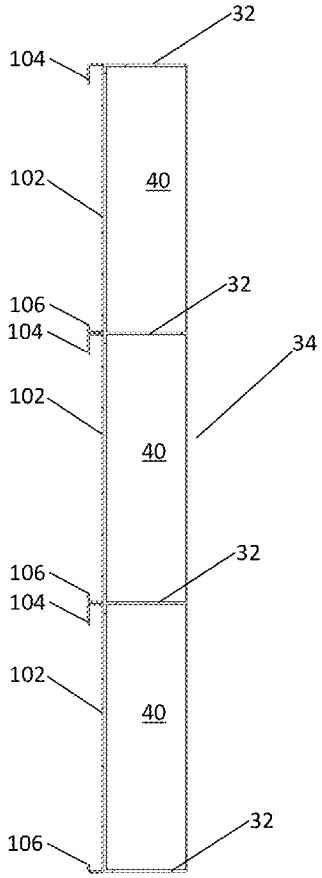
FIG. 10 is a cross-sectional view of the cabinet structure and closure panels of FIG. 7, taken along the line 10-10.
Figure 11:
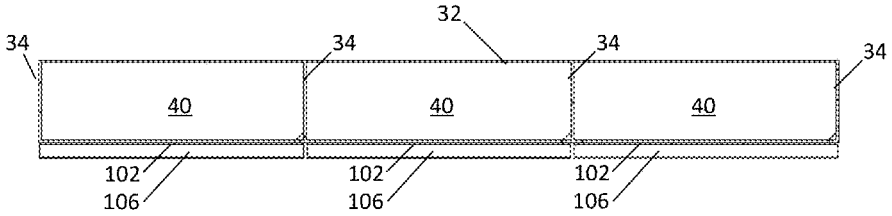
FIG. 11 is a cross-sectional view of the cabinet structure and closure panels of FIG. 7, taken along the line 11-11.

With reference to FIGS. 1-3, a columbarium 10 is shown. Columbarium 10 is for providing a plurality of individual niche compartments 40 for storing cinerary urns or the like. In the embodiment shown, columbarium 10 is free standing. However, in other embodiments, columbarium 10 may be part of another structure, such as a mausoleum. As shown, columbarium 10 is part of a granite structure having a front 14, a first side 16, and a second side 18. Other materials or a combination of materials may be used for columbarium 10, such as marble, limestone, sandstone, bronze, and other types of stone and metals. A plurality of individual niche compartments 40, covered by associated face plates 200 are provided on each of the front 14 and sides 16, 18. As shown, front 14 includes 20 niche compartments 40 and face plates 200 arranged in a 4×4 array and a lower 4×1 array. The first side 16 is shown as having 16 niche compartments 40 and face plates 200 arranged in a 4×4 array. The second side 18 has the same arrangement as the first side 16. The rear side (not shown) of the columbarium 10 may also include arrangements similar to the front 14 or the sides 16, 18. As shown, the face plate 200 fields may be bounded on each side by additional columbarium structures, such as sides 14*a*, 14*b*, 14*c*, and 14*d* for the 4×4 field on the front 14. It should be appreciated that the columbarium can have any number of sides (such as one, two, three, four, five, six, etc.) and each side can contain any size array of niche compartments and face plates. Any side containing an array can be provided as straight or curved.

Referring to FIGS. 3-6, a cabinet structure 30 for installation into the columbarium 10 is shown. The cabinet structure 30 may be provided within the columbarium 10 to define the individual niche compartments 40. In one embodiment, cabinet structure 30 is provided with a plurality of horizontal members 32 and a plurality of vertical members 34. The cabinet structure 30 can also be provided with a front face 30*a* and a backing (not shown). A backing could be provided by some other portion of the columbarium structure. The front face 30*a* can be integral to the horizontal and vertical member 32, 34, or could be a separate component attached to the horizontal and vertical members 32, 34. Together, the horizontal members 32, the vertical members 34, and the backing if provided, form a plurality of niche compartments 40, each of which defines an opening 40*a* at the front face 30*a* of the cabinet structure 30. As shown, each opening 40*a* has a height 40*h* and a width 40*w*. In one embodiment, opening 40*a* is a rectangular opening (for example, square) wherein 40*h* is about 12 inches and width 40*w* is about 12 inches. Other dimensions and shapes are also possible.

As shown, cabinet structure 30 has four horizontal members 32 and four vertical members 34 that define nine individual niche compartments 40 in a 3×3 configuration. It is to be understood that cabinet structure 30 could be configured to define any number of niches in any particular pattern or array. For example, referring to FIGS. 1 and 2, columbarium 10 is provided with a 4×4 frame structure on each of two sides 16, 18 and a front 14, and an additional 4×1 frame structure on the front 14.

The front face 40*a* of the cabinet structure 30 may also be provided with a plurality of mounting holes 38 for receiving mounting screws that retain face plate hangers 100 (discussed later). In the embodiments shown, four mounting holes 38 are shown for each niche compartment 40 location. It is also noted that, to accommodate mounting of the face plate hangers 100 and face plates 200, the faces of the interior horizontal and vertical members 32, 34 are shown as having a greater width than the faces of the horizontal and vertical members 32, 34 that form the perimeter of the cabinet structure 30.

Referring to FIGS. 7-13, the face plate hanger 100 system is shown in greater detail. Face plate hanger 100 is for supporting the face plates 200, and can also be used for sealing or concealing the opening 40*a* of the niche compartment(s) 40. As shown, in FIGS. 7 and 9, a face plate hanger 100 is provided for each niche compartment 40. However, in other embodiments, a face plate hanger 100 can be provided for multiple niche compartments 40.

In the embodiment shown, face plate hanger 100 includes a closure panel 102 and a rail arrangement having a first rail 104 and a second rail 106. The closure panel 102 has a width 102*w* and a height 102*h*. In one embodiment, width 102*w* is greater than the niche compartment opening width 40*w* and height 102*h* is greater than the niche compartment opening height 40*h*. For example, in the embodiment shown, opening width 40*w* and height 40*h* are each about 12 inches and width 102*w* and height 102*h* are about 13 inches. In such an example, the closure panel 102 has a surface area that is greater than the area defined by the opening width 40*w* and height 40*h*.

As shown, the first rail 104 is arranged at a first end 102*a* of the closure panel 102 and extends between a first side 102*c* and a second side 102*d* of the closure panel 102. As shown, the second rail 106 is arranged at a second opposite end 102*b* of the closure panel 102 and extending between a first side 102*c* and a second side 102*d* of the closure panel 102. The closure panel may also be provided with mounting holes 108, shown as aligning with mounting holes 38 on the cabinet structure, for mounting the face plate hanger 100 to the cabinet structure 30.

Although a closure panel 102 is shown, it is to be understood that face plate hanger 100 could be provided without a closure panel 102 wherein the first rail 104 and the second rail 106 of the rail arrangement are mounted directly to the cabinet structure 40 or to another structural portion of the columbarium 10. Additionally, the face plate hanger 100 system may be configured to provide a first rail 104 at the top horizontal member 32 of the cabinet 30 structure, a combined first rail 104 and second rail 106 component for the intermediate horizontal members 32, an a second rail 106 at the bottom horizontal member 32. The rails 104, 106 may extend a across a portion of the compartment 40, extend across the general length of a single compartment 40, extend the length of the entire cabinet structure 40, or extend dimensions there between.

Figure 12:
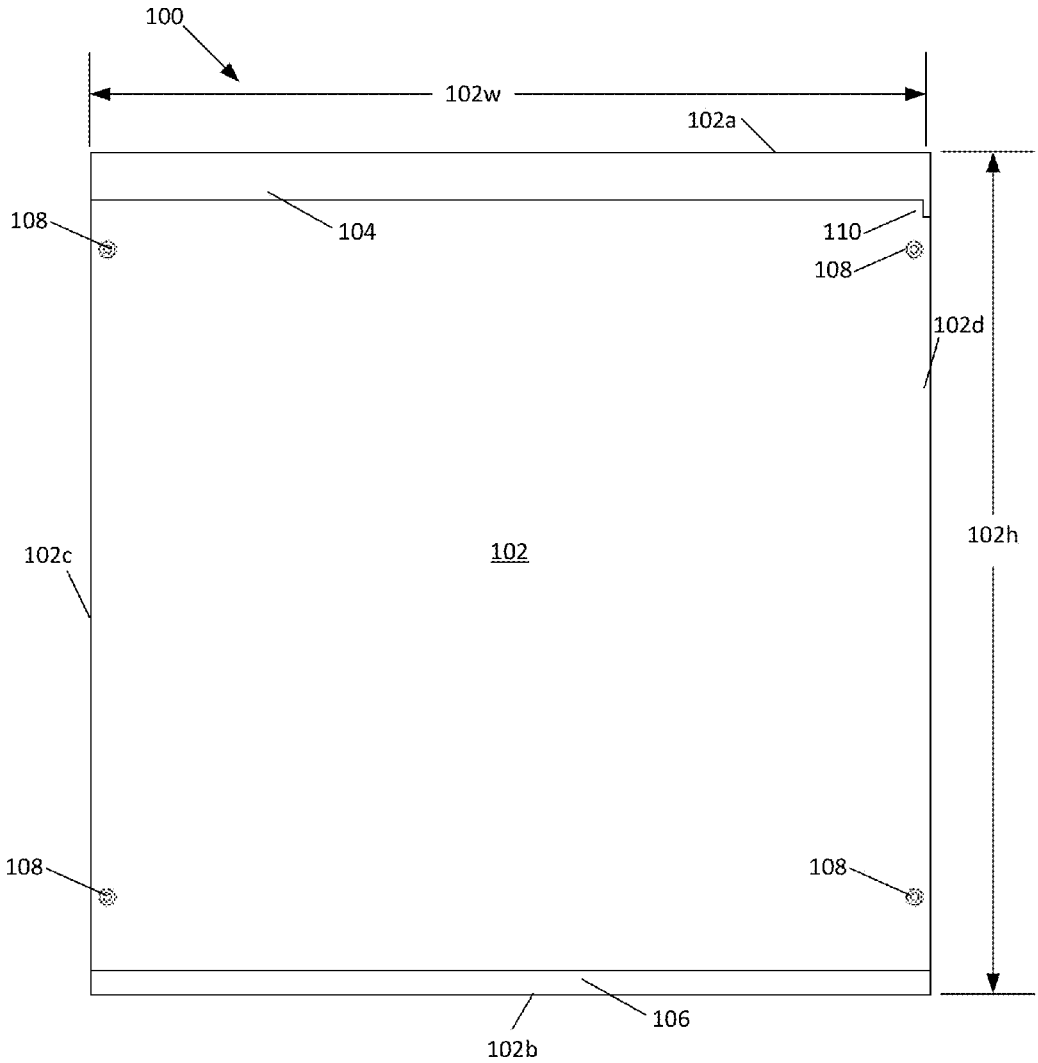
FIG. 12 is a front view of one of the closure panels shown in FIG. 7.
Figure 13:
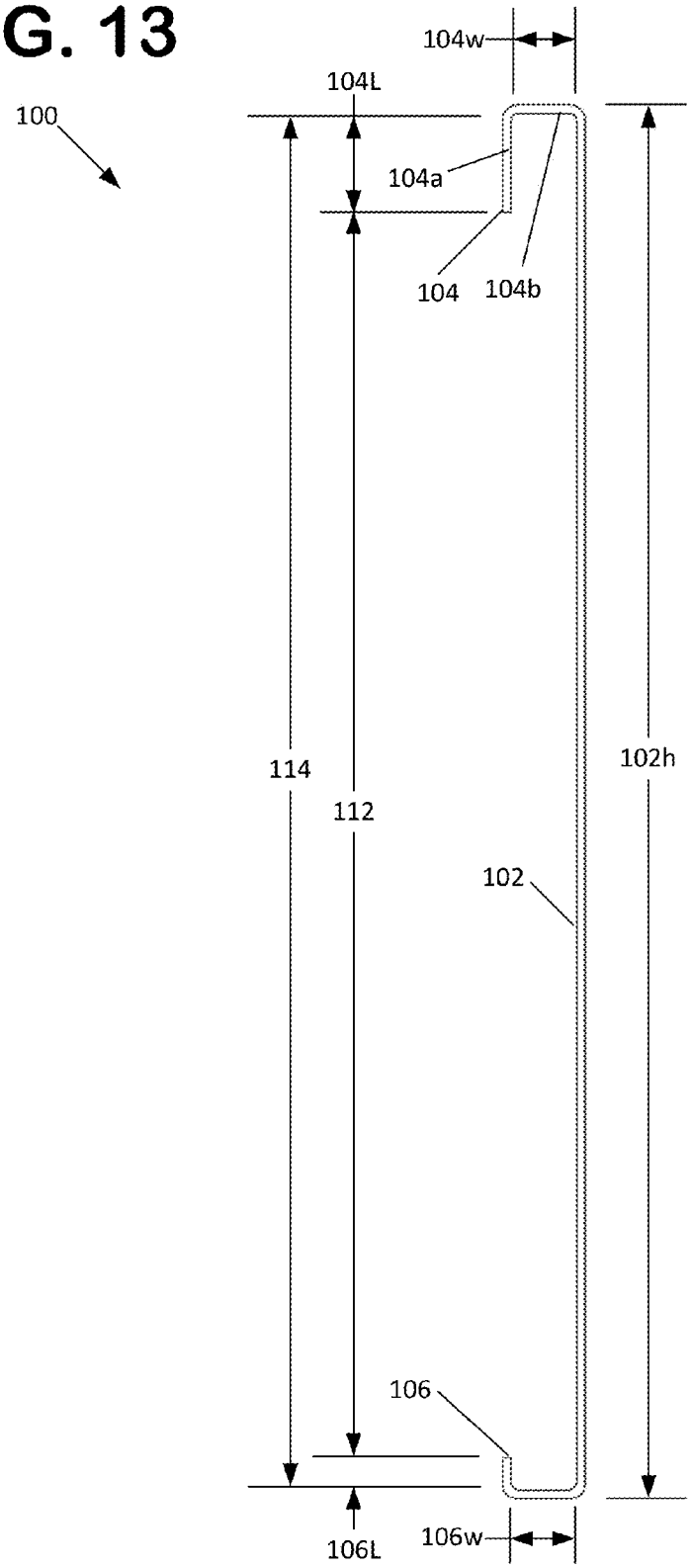
FIG. 13 is a side view of the closure panel shown in FIG. 12.

As most easily seen at FIGS. 12 and 13, the first rail 104 and the second rail 106 are generally directed towards each other such that the first rail 104 is directed towards the closure panel second end 102*a* and the second rail 106 is directed to towards the closure panel first end 102*b*. As shown, the first rail 104 may include a base portion 104*b* and an extension member 104*a* wherein the base portion 104*b* extends generally perpendicularly away from the closure panel 102 and the extension member 104*a* extends from the base portion 104*b* in a direction towards the second end 102*b* of the closure panel 102. As shown, the second rail 106 may include a base portion 106*b* and an extension member 106*a* wherein the base portion 106*b* extends generally perpendicularly away from the closure panel 102 and the extension member 106*a* extends from the base portion 106*b* in a direction towards the first end 102*a* of the closure panel 102. As shown, the first and second extension members 104*a* are separated from the closure panel 102 a distance equal to the interior width (discussed below) of the base portions 104*b*, 106*b*, respectively.

As shown, the first extension member 104*b* has a length 104L and the second extension member 106*b* has a length 106L. As can be seen at FIG. 13, the distal ends of the extension members 104*b*, 106*b* that generally extend towards each other are separated by a distance 112. In one embodiment, the first extension member length 104L is about 0.75 inch, the second extension member length 106L is about 0.375 inch, and the separating distance 112 is about 11.8 inches. While length 104L is shown as being greater than length 106L, the lengths may be the same, or length 106L may be greater than 104L in certain applications. However, it is preferable for length 106L to be at a length such that the face plate 200 does not need to be lifted to an extensive degree in order to remove the face plate 200 from the frame hanger 100.

As shown, the first extension member base portion 104*a* has an interior width 104*w* and the second extension member base portion 106*a* has an interior width 106*w*. As can be seen at FIG. 13, the base portions 104*a*, 106*a* are separated by a distance 114. In one embodiment, the first base portion width 104*a* is about 0.5 inch, the second base portion interior width 106*w* is about 0.8 inch, and the distance 112 between the base portions 104*a*, 106*a* is about 11.7 inches. While width 106*w* is shown as being greater than width 104*w*, the widths may be the same, or width 104*w* may be greater than width 106*w*. However, it is preferable for widths 104*w* and 106*w* to be of sufficient dimensions to allow the face plate 200 to be easily installed and removed from the frame hanger 100.

The first rail 104 may also be provided with a retaining tab 110 for securing the face plate 200 to the frame hanger 100 in a retained position. As most easily seen, retaining tab 110 extends from the first extension member 104*a* towards the second rail or the second end 102*b* of the closure panel. In the particular embodiment shown, retaining tab 110 extends at least about ⅛ inch, and preferably about ¼ inch from the edge of the first extension member 104*a* opposite the base 104*b*. Retaining tab 110 functions to decrease the opening distance 112 at the location of the tab 110 such that, when the face plate 200 is engaged with the retaining tab, insufficient clearance exists for the face plate to be lifted out and disengaged with the second rail. When the face plate 200 is not engaged with the retaining tab 110 in a lift-out position, the face plate 200 can be lifted up and disengaged from the second rail 106.

Referring to FIGS. 14-19, the face plate 200 and the assembled closure system are shown in greater detail. As most easily seen at FIGS. 14 and 17, the face plates 200 are mounted to the face plate hangers 100 and arranged such that the sides of adjacent face plates 200 are separated from each other by a distance 224. In one embodiment, distance 224 is about 0.375 inch. Distance 224 may be less than 0.375 inch, for example 0.125 inch, however removal of the face plate 200 becomes more difficult with reduced clearance. Distance 224 may be greater than 0.375 inch, however, as distance 224 increases the materials behind face plates (e.g. the face plate hangers 100 and granite structure there between) are more visible.

Figure 14:
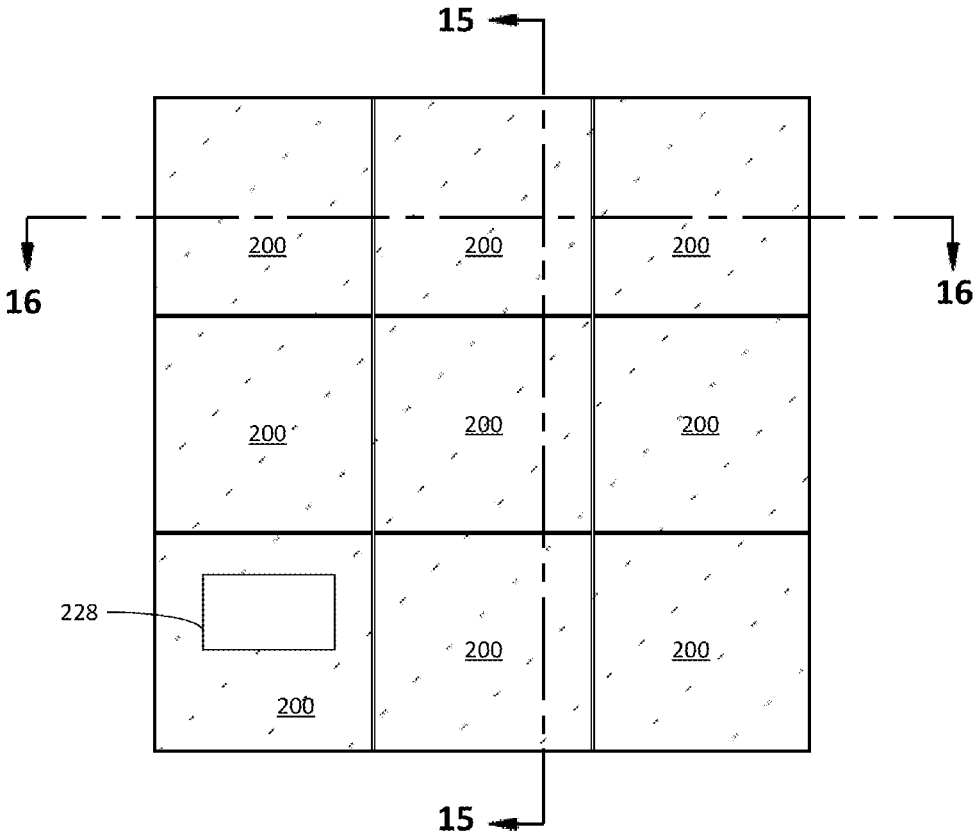
FIG. 14 is a front view of an assembled closure system including face plates mounted onto the closure panels and cabinet of FIG. 7.
Figure 15:
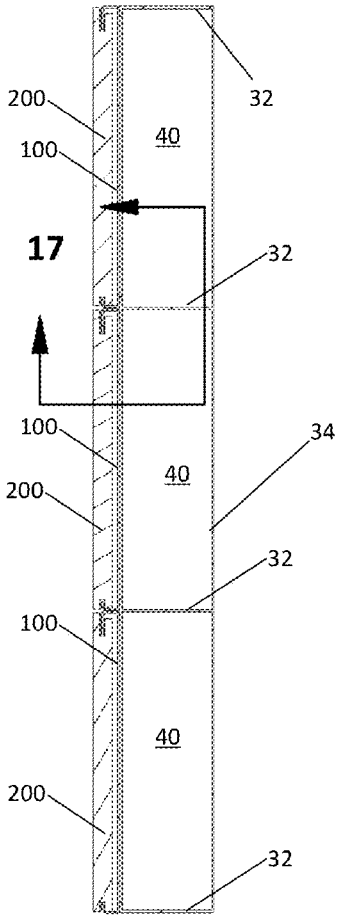
FIG. 15 is a cross-sectional view of the assembled closure system of FIG. 14, taken along the line 15-15.
Figure 16:
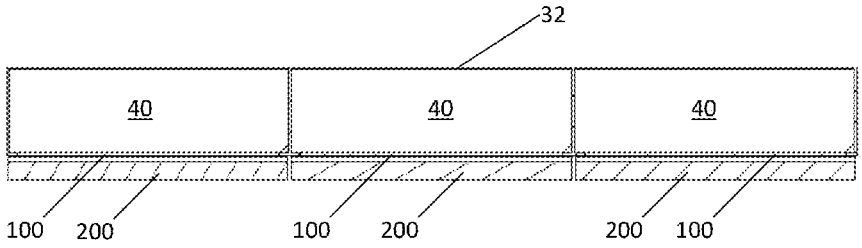
FIG. 16 is a cross-sectional view of the assembled closure system of FIG. 14, taken along the line 16-16.

As can be seen at FIG. 14, the face plates 200 may be provided with a mounting or indicia 228. The mounting or indicia 228 can be an engraving directly on the face panel 200 or provided as a cast product, for example a cast product having a photographic relief image therein. Casts products containing a photographic relief image therein can be prepared according to U.S. Patent Publication 2008/0148539 to Sheperd et al. The entire disclosure of U.S. Patent Publication 2008/0148539 to Sheperd et al. is incorporated herein by reference.

As shown, each face plate 200 has a height 200*h* extending between a first edge 206 and a second edge 208, a width 200*w* extending between a third edge 210 and a fourth edge 212, and a thickness 200*t* extending between a front face 202 and a rear face 204. In one embodiment, such as the shown embodiment, the face plate has a square shape wherein height 200*h* and width 200*w* are about 12.8 inches and has a thickness of about 0.8 inches. In one embodiment, such as the shown embodiment, the front face 202 is about 1⅛ inches from the front face 30*a* of the cabinet structure. Accordingly, the resulting surface area of the face plate 200 is only slightly less than that of the closure panel 102 and thus conceals a majority of the closure panel 102 surface area and fully conceals the mounting holes 138.

Figure 17:
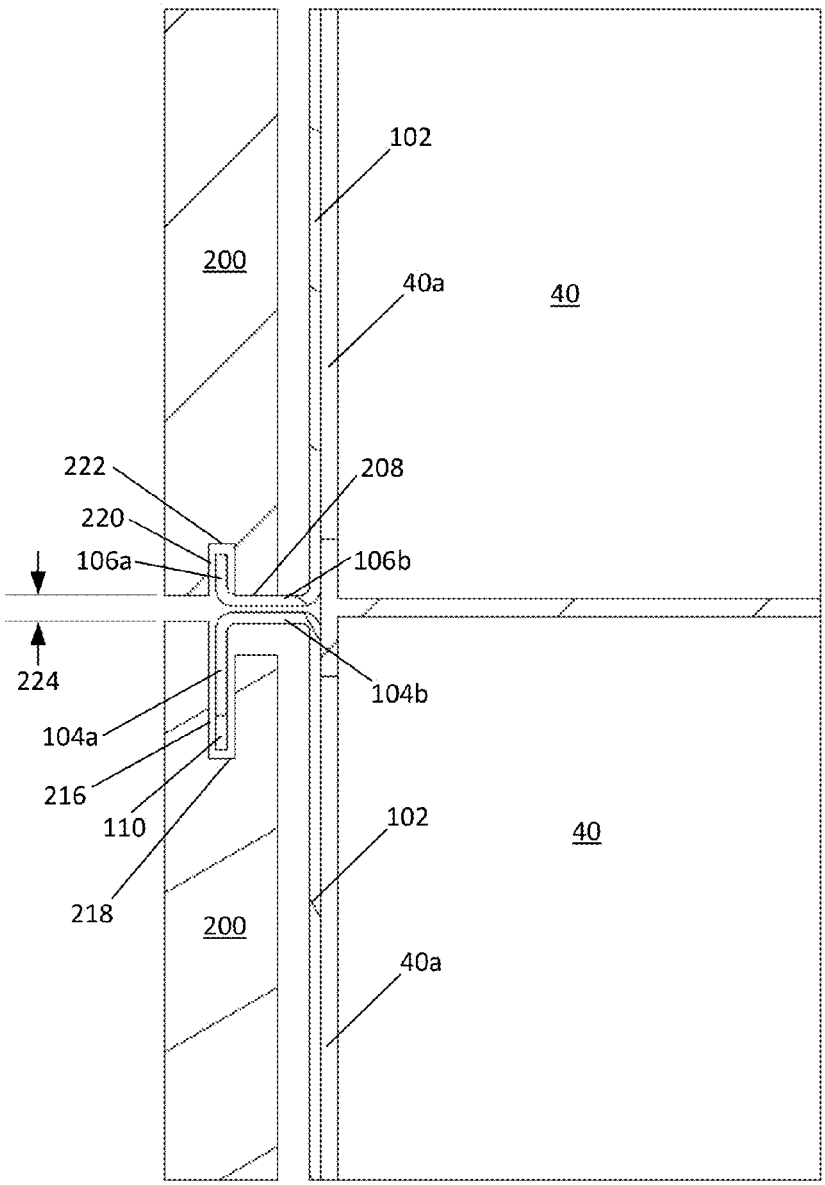
FIG. 17 is an enlarged view of a portion of the assembled closure system of FIG. 14 at location 17 indicated at FIG. 15.
Figure 18:
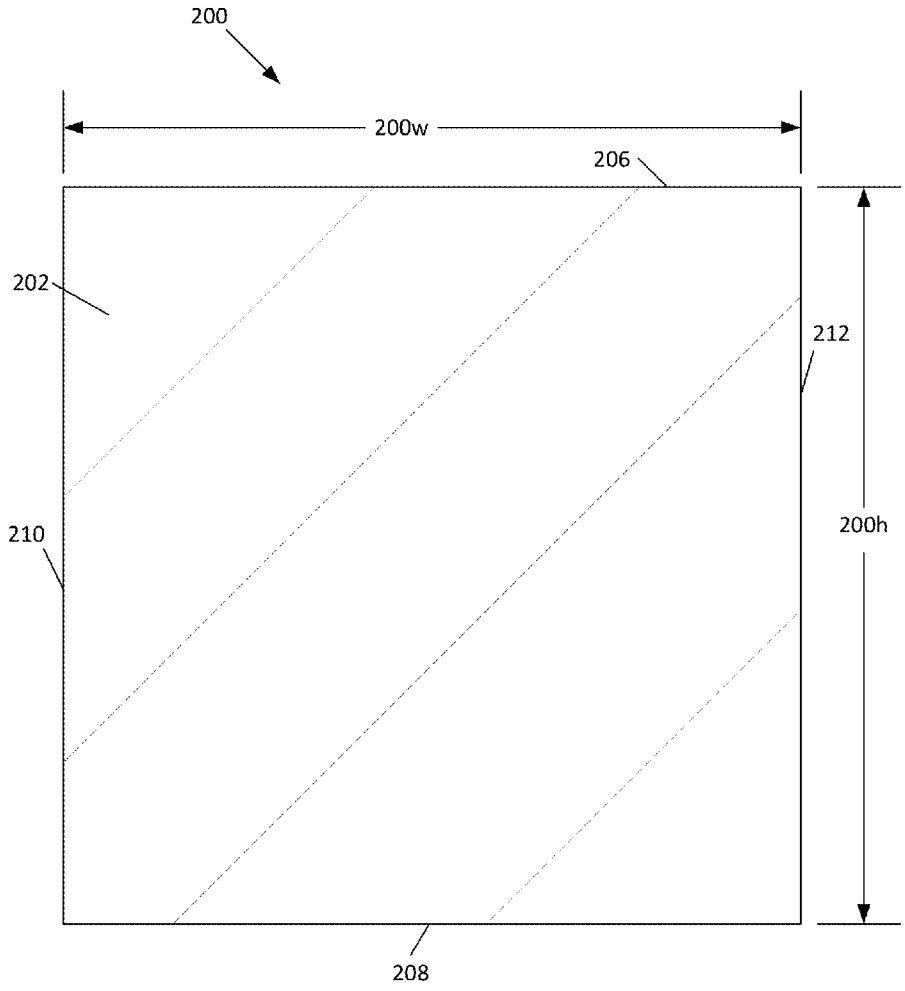
FIG. 18 is a front view of one of the face plates shown in FIG. 14.
Figure 19:
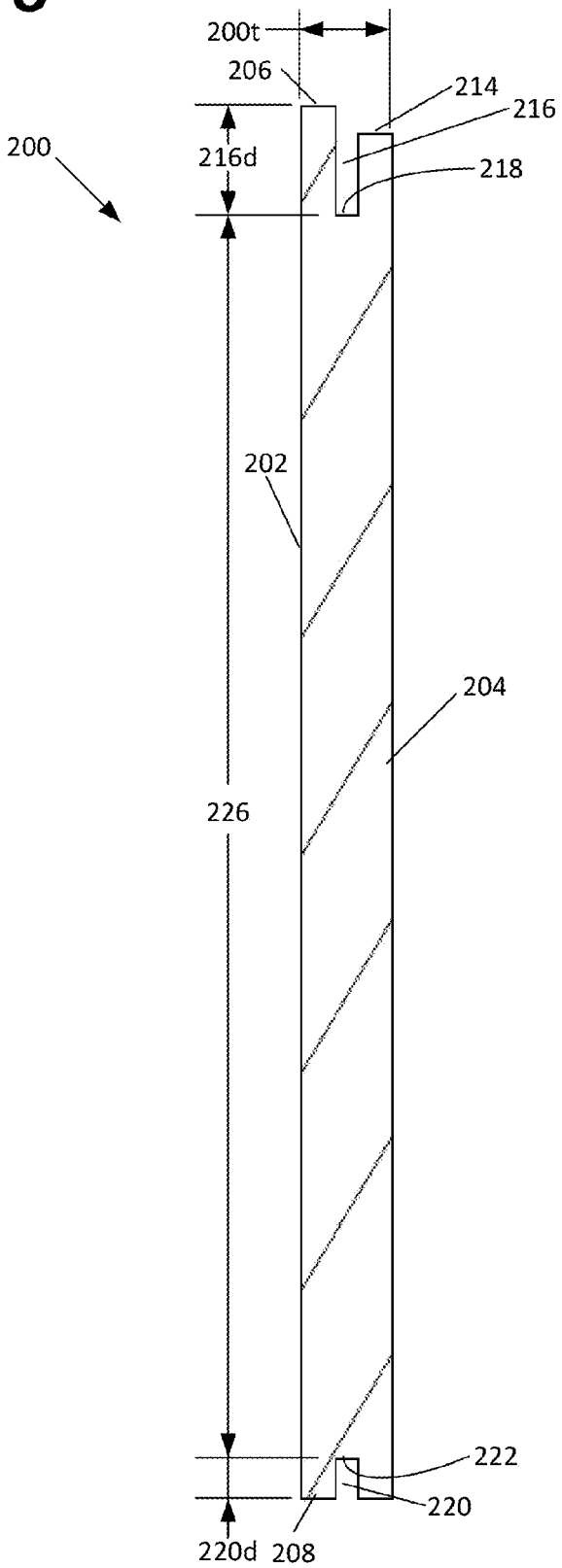
FIG. 19 is a side view of the face plate shown in FIG. 14.

Referring to FIGS. 17 and 19, the face plate 200 is shown as including a first channel 216 and a second channel 220. The first channel 216 is for engaging a portion of the first rail 104, for example the first rail extension member 104*a* while the second channel 220 is for engaging a portion of the second rail 106, for example the second rail extension member 106*a*.

As shown, first channel 216 has a width of about ⅛ inch that is the same as or greater than a thickness of the first rail extension member 104*a*, and a depth 216*d* defined between the front face first edge 206 and a first channel base 218. In one embodiment, such as the shown embodiment, depth 216*d* is about 1 inch. At the location of the first channel 216, the face plate 200 may be provided with a rabbit or cutaway portion 214 at the first edge to allow for easier removal and installation of the face plate 200. As shown, the cutaway portion 214 has about 0.25 inch of material removed from the rear face 204. As shown, second channel 220 has a width of about ⅛ inch that is the same as or greater than a thickness of the second rail extension member 106*a*, and a depth 220*d* defined between the front face second edge 208 and a second channel base 220. In one embodiment, such as the shown embodiment, depth 220*d* is about 0.375 inch which is slightly greater than the length of the second rail extension member 106*a* thereby allowing the second edge 208 of the face plate 200 to rest against the second rail base 106*b* when the face plate 200 is installed. As can be seen at FIG. 19, the channel bases 218, 222 are separated by a distance 224.

To install the face plate hanger 100 to cabinet structure 30 (or another structure within columbarium 10), the mounting holes 108 on the hanger 100 are aligned with the mounting holes 38 on the cabinet structure. Subsequently, fasteners such as screws, anchors, and/or bolts are used to secure the face plate hanger 100. Where it is desired to seal the opening 40*a* of the niche, a cover panel 102 can be provided as part of face plate hanger 100 and a sealant, such as caulk or an adhesive, may be provided between the cover panel 102 and cabinet front face 30*a*.

To install a face plate 200 onto the face plate hanger 100, the face plate 200 is first presented at an angle to the face plate hanger 100 such that the face plate second edge 208 is farther away from the hanger 100 than is the face plate first edge 206. The face plate 200 is also aligned to be laterally offset from the first rail retaining tab 110. The face plate first channel 216 is then aligned with the hanger first rail 104 and lifted upwards such that a portion of the first rail 104 (e.g. first extension member 104*a*) is received within the first channel 216, and such that the face plate second edge 208 is at a higher elevation than the second rail 106. The face plate second edge 208 is then moved towards the hanger 100 and aligned with the second rail 106 such that the face plate second channel 220 can receive a portion of the hanger second rail 106 (e.g. the second extension member 106*a*). The face plate 200 is then lowered with the second channel 220 receiving the second rail 106 until a portion of the face plate 200 rests upon a portion of the second rail 106 (e.g. the second edge 208 rests on second rail base 106*b*). The face plate 200 is now engaged by both the first and second rails 104, 106 and is retained by gravity such that it is not removable from the face plate hanger 100 without first lifting the face plate 200 in an upward direction. This position may be referred to as a "lift-out position."

To place the face plate 200 in a "retained position" wherein the face plate 200 is prevented from being lifted in an upward direction such that it could be removed from the face plate hanger 100, the face plate is slid laterally on the rails until the retaining tab 110 is engaged within the face plate first channel 216. As the distance 112 between the rails at the location of the retaining tab is very close to the distance 224 between the first and second channel bases 218, 222 (i.e. the difference between distances 224 and 112 is less than the second extension member length 106L), the face plate 200 has insufficient clearance to lift out of the face plate hanger 100 without first being laterally offset away from the retaining tab 110. The removal of the face plate 200 from the hanger 100 is the reverse of the above described installation procedure.

The above described lifting procedure may be performed manually with or without tools. One tool usable to aid in lifting the face plate 200 is a suction cup tool that can create a vacuum to hold the face plate 200 and a handle for a person to better manipulate the face plate 200.

However, a person may use his/her fingers alone to remove the panel where distance 224 is sufficiently sized. It has been found that a dimension of 3/16 inch is sufficient for manual removal of the face plate 200 without tools of any kind.

It is also noted that the entire installation and removal process of the face plate 200 with respect to the face plate hanger 100 is performed without damaging the face plate 200 or adjacent structures in any way. As such, the term "removable," as used herein, is taken to mean a process in which the face plate 200 can be separated from the face plate hanger 100 with all structures of the face plate 200 fully intact. It is further noted that the face plate 200 is secured to the face plate hanger 100 in both the lift-out position and the retained position without the use of any type of separate fasteners. Non-limiting examples of fasteners include screws, bolts, nuts, anchors, adhesives, sealants, tape, caulk, clips, and brackets that are not integral to the structure of the face plate 200.

The cabinet structure 30, the face plate hanger 100, and the face plate 200 may be constructed from a variety of materials. For example, these components may be wood, plastic, stone, metal, and/or a combination of such materials. Non-limiting examples of metal materials are steel, cast iron, aluminum, bronze, and other metals commonly used for memorial products. Examples of stone materials are granite, limestone, sandstone, and marble. In one embodiment, the cabinet structure 30 and the face plate hangers 100 are constructed from a metal material while the face plate 200 is constructed from a stone material. In the embodiment shown, the cabinet structure 30 and the face plate hangers 100 are constructed from aluminum while the face plate 200 is constructed from granite. It is also noted that the disclosed face plate 200 and face plate hanger 100 are each shown as being a single-piece, unitary structure made from a single material.

Now referring to FIG. 3, an exemplary cinerary urn containing the ashes of a cremated person is illustrated at reference number 300. It should be appreciated that the columbarium can contain a cinerary urn 300 in any of the plurality of individual niche compartments 40. In addition, the depth of the niche compartments can be provided so that they have any desired depth sufficient to accommodate the cinerary urns contemplated for storage in the columbarium. In addition, the cinerary urn 300 can be considered an object 300 for storage in the array. Exemplary objects for storage include personal objects and memorial objects.

Although specific embodiments have been illustrated and described herein, it will be appreciated by those of ordinary skill in the art that a variety of alternative and/or equivalent implementations may be substituted for the specific embodiments shown and described without departing from the scope of the present disclosure. Furthermore, although the closure system is described for a memorial product, such as a columbarium, the closure system is not limited to only such applications and has utility for other applications where removable panels are desired. Additionally, although a complete columbarium structure is shown and described, it is noted that the disclosed closure system including face plates and face plate hangers may be applied in a retrofit application on an existing columbarium or other structure (e.g. the conversion of a crypt into a columbarium) where openings are desired to be covered. The application is intended to cover any adaptations or variations of the specific embodiments discussed herein. Therefore, it is intended that this invention be limited only by the claims and the equivalents thereof.

We claim:

1. A closure system for a niche compartment comprising:

(a) a face plate hanger including a rail arrangement comprising:
  i. a first rail provided at a first end of a niche compartment opening;
  ii. a second rail provided at a second end of a niche compartment opening, the second end being opposite the first end;
  iii. wherein the first rail and the second rail are generally directed towards each other; and (b) a face plate constructed to extend from the first rail to the second rail, the face plate comprising;
  i. a first end comprising a first channel constructed to receive the first rail;
  ii. a second end comprising a second channel constructed to receive the second rail;
  iii. wherein the first rail has a first base member and a first extension with a first edge opposite the first base member and the second rail has a second base member and a second extension, wherein the first and second extensions are generally directed towards each other;
  iv. wherein the first rail further comprises a retaining tab for securing the face plate to the face plate hanger in a retained position wherein the retaining tab extends beyond the first edge of the first extension;
  v. wherein the retaining tab is integral to the first rail and extends at least 0.125 inch from the first edge;
  vi. wherein the face plate is slidable relative to the face plate hanger from a lift-out position to the retained position:
    (A) the lift-out position being a position in which the retaining tab is not received in the face plate first channel thereby allowing the face plate to be lifted in a direction towards the top rail and removed from the closure panel;
    (B) the retained position being a position in which the retaining tab is received in the first channel such that the face plate cannot be lifted in a direction towards the first rail and removed from the closure panel.

2. The closure system of claim 1, wherein the face plate hanger further comprises:

(a) a closure panel configured to cover the niche opening, the closure panel extending between the first rail and the second rail.

3. The closure system of claim 1, wherein the first extension is longer than the second extension.

4. The closure system of claim 1, wherein the face plate is held in the retained position without mechanical fasteners separate from the first and second rails.

5. The closure system of claim 1, wherein the face plate has a first face having a height that is equal to or greater than a distance between the first and second rail base members.

6. The closure system of claim 5, wherein the face plate has a second face having a height that is less than the height of the first face.

7. The closure system of claim 2, wherein the closure panel is provided with mounting holes.

8. The closure system of claim 7, wherein the face plate covers the mounting holes when the face plate is secured to the closure panel.

9. The closure system of claim 1, wherein the face plate hanger is a metal material.

10. The closure system of claim 9, wherein the closure panel is aluminum.

11. The closure system of claim 1, wherein the face plate is a stone material.

12. The closure system of claim 11, wherein the face plate is granite.

13. The closure system of claim 1, wherein the face plate is a metal material.

14. The closure system of claim 13, wherein the face plate is bronze.

15. The closure system of claim 1, wherein the face plate hanger is aluminum and the face plate is granite.

16. A columbarium comprising:

(a) at least one cabinet structure defining a plurality of individual niche compartments, wherein each individual niche compartment has an opening that is concealed by the closure system of claim 1.

17. The columbarium of claim 16, wherein the first and second rails are attached to the cabinet structure by mechanical fasteners.

18. The columbarium of claim 16, wherein the first rail further comprises a retaining tab for securing each face plate to each face plate hanger in a retained position.

19. The columbarium of claim 18, wherein the retaining tab has a width that is less than a distance between adjacent face plates when the face plates are in the retained position.

20. The columbarium of claim 16, wherein the cabinet structure defines at least four individual niche compartments.

21. A closure system for a niche compartment comprising:

(a) a face plate hanger including a closure panel for covering an opening of the niche compartment and a rail arrangement comprising:

i. a first rail provided at a first end of the closure panel;

ii. a second rail provided at a second end of the closure panel, the second end being opposite the first end;

iii. wherein the first rail and the second rail are generally directed towards each other; and (b) a face plate constructed to fit between the first rail and the second rail, the face plate comprising;

i. a first end comprising a first channel constructed to receive the first rail;

ii. a second end comprising a second channel constructed to receive the second rail;

iii. wherein the first rail has a first base member and a first extension with a first edge opposite the first base member and the second rail has a second base member and a second extension, wherein the first and second extensions are generally directed towards each other;

iv. wherein the first rail further comprises a retaining tab for securing the face plate to the face plate hanger in a retained position wherein the retaining tab extends beyond the first edge of the first extension;

v. wherein the retaining tab is integral to the first rail and extends at least 0.125 inch from the first edge;

vi. wherein the face plate is slidable relative to the face plate hanger from a lift-out position to the retained position:

(A) the lift-out position being a position in which the retaining tab is not received in the face plate first channel thereby allowing the face plate to be lifted in a direction towards the top rail and removed from the closure panel;

(B) the retained position being a position in which the retaining tab is received in the first channel such that the face plate cannot be lifted in a direction towards the first rail and removed from the closure panel.

22. The closure system of claim 21 wherein the face plate second end rests upon a base of the second rail when the face plate is engaged with the face plate hanger.

23. A columbarium comprising:

(a) at least one cabinet structure defining a plurality of individual niche compartments, wherein each individual niche compartment has an opening that is concealed by the closure system of claim 19.

24. The columbarium of claim 23, wherein the cabinet structure defines at least nine individual niche compartments, each individual niche compartment having an adjacent face panel.

25. The columbarium of claim 24, wherein the adjacent face panels have a first spacing of at least 0.125 inch between sides of adjacent face panels.

26. The columbarium of claim 25, wherein the first spacing is about 3/16 inch.

27. The columbarium of claim 23, further comprising a plurality of cinerary urns wherein each cinerary is stored in a separate one of the plurality of individual niche compartments.

* * * * *